United States Patent [19]

Carmo et al.

[11] 4,449,776

[45] May 22, 1984

[54] ELECTRICAL CONNECTOR HAVING OPPOSED LOCKING RAMP MEMBERS

[75] Inventors: Robert A. Carmo, Placentia; Ernest W. Dietz, Torrance, both of Calif.

[73] Assignee: Pacific Electricord Company, Gardena, Calif.

[21] Appl. No.: 416,931

[22] Filed: Sep. 13, 1982

[51] Int. Cl.[3] ..... H01R 13/62

[52] U.S. Cl. ..... 339/91 R; 339/103 C; 339/107; 339/206 R

[58] Field of Search ..... 339/196 R, 196 M, 206 R, 339/206 P, 184 R, 184 M, 186 R, 186 M, 102 R, 103 C, 107, 91 R

[56] References Cited

U.S. PATENT DOCUMENTS

| | | | |
|---|---|---|---|
| 1,677,734 | 7/1928 | Smith | 339/91 R |
| 1,835,251 | 12/1931 | Wetstein | 339/91 R |
| 2,234,745 | 3/1941 | Rarrel | 173/334.1 |
| 2,236,167 | 3/1941 | David | 173/343 |
| 2,272,432 | 11/1940 | Rogie | 339/196 R |
| 2,293,635 | 8/1942 | Wulle | 173/330 |
| 2,386,177 | 10/1945 | Anderson | 173/328 |
| 2,891,103 | 6/1959 | Swengel | 339/91 R |
| 3,141,721 | 7/1964 | Horn | 339/176 |
| 3,399,374 | 8/1968 | Pauza et al. | 339/184 M |
| 3,611,261 | 10/1971 | Gregory | 339/91 R |
| 3,671,921 | 6/1972 | Baker et al. | 339/206 R |
| 3,781,766 | 12/1973 | Teagno et al. | 339/107 |
| 3,874,763 | 4/1975 | Hoover | 339/91 R |
| 3,880,487 | 4/1975 | Goodman et al. | 339/60 R |
| 3,933,406 | 1/1976 | Cameron et al. | 339/91 R |
| 3,941447 | 3/1976 | Hargrave | 339/91 R |
| 3,982,809 | 9/1976 | Ward | 339/91 R |
| 4,008,940 | 2/1977 | Foley | 339/91 R |
| 4,046,449 | 9/1977 | Ranzanigo | 339/126 R |
| 4,138,185 | 2/1979 | Jaconette, Jr. | 339/107 |
| 4,150,866 | 4/1979 | Snyder, Jr. | 339/91 R |
| 4,169,648 | 10/1979 | Moist, Jr. | 339/206 P |
| 4,202,590 | 5/1980 | Hoffman | 339/107 |
| 4,403,821 | 9/1983 | Zimmerman et al. | 339/107 |

FOREIGN PATENT DOCUMENTS

| | | | |
|---|---|---|---|
| 1929470 | 2/1970 | Fed. Rep. of Germany | 339/91 R |
| 0676043 | 7/1952 | United Kingdom | 339/196 R |

*Primary Examiner*—John McQuade
*Assistant Examiner*—Thomas M. Kline
*Attorney, Agent, or Firm*—Fulwider, Patton, Rieber, Lee & Utecht

[57] ABSTRACT

An electrical connector comprising a hollow first connector body housing electrical connector blades and adapted to receive a hollow second connector body housing electrical contacts for receiving the connector blades. Blade insertion and withdrawal forces are minimized by using generous tolerances and assuring integrity of the connection through utilization of opposed locking ramp members to resist connector and power cord separation forces. Exterior lock members on the second connector body engage a pair of first ramp members on the first connector body. A power cord strain relief fitting is held within an insert assembly which is insertable into an open end of the second connector body. Second ramp members on the insert assembly engage openings in the second connector body whereby axial forces on the strain relief fitting are transferred from the insert assembly to the second connector body, and then to the first connector body by means of the first ramp members.

3 Claims, 3 Drawing Figures

ELECTRICAL CONNECTOR HAVING OPPOSED LOCKING RAMP MEMBERS

BACKGROUND OF THE INVENTION

1. Field of the Invention

The present invention relates to mateable electrical connector bodies interlockable for transfer of all connector and power cord separation forces to the structure of the connector bodies, and unlockable for electrical connection and disconnection with minimium insertion and withdrawal forces.

2. Description of the Prior Art

In joining a pair of connector bodies to inter-engage the internal electrical connector blades and contacts of the bodies it is important to insure that the blades and contacts are tightly engaged and are constrained from inadvertent separation, and that strains on the power cord are not transmitted to the electrical connections. This is accomplished by many connectors of the prior art by providing various forms of strain relief fittings and by providing a close tolerance fit between the blades and contacts and also between the connector bodies. However, an undesirably high insertion and withdrawal forces are required, in addition to the manufacturing problems associated with producing and assembling close tolerance parts. Further, such high forces often result in unseating of the strain relief fitting.

One form of prior art connector reduces the necessary insertion and withdrawal forces by providing ramps on one of the connector bodies engageable by locking members on the other connector body. This arrangement works reasonably well, but there is no corresponding reduction in the insertion forces required to fit the usual power cord strain relief fitting into its connector body.

In some prior art designs the strain relief fitting is made of resilient material which is pressed through an undersized opening in the connector body to seat it in position and, consequently, an equal withdrawal force will undesirably unseat the strain fitting from its connector body and damage the internal wiring connections.

In other arrangements of the prior art the strain relief fitting is specially configured to fit through a complementally configured opening in the connector body, following which the strain relief fitting is turned or indexed to maintain it in position. What is needed, however, is an overall connector in which the various parts can be joined together or assembled with minimum forces, but which can be quickly and easily locked together to maintain the integrity of the connection or assembly.

SUMMARY OF THE INVENTION

According to the present invention, a pair of electrical connector bodies having internal, mutually engageable electrical connector blades and contacts are joinable and separable with minimum insertion and withdrawal forces. This is accomplished by providing generous tolerances between the interfitting parts, consistent with good electrical conducting relationship, and by providing positive locking through interengagement between locking members on one connector body and first ramp members on the other connector body. The locking members are easily pivotable to unlock the bodies when desired.

The female connector body axially slidably accepts the assembled halves of an insert assembly having collar recesses adapted to close about the collar of a power cord strain relief fitting to securely hold the fitting in position within the insert assembly.

The interfitting portions of the insert assembly and the associated connector body are characterized by generous tolerances so that assembly can be made with minimum insertion forces. The insert assembly includes oppositely located second ramp members which fit or snap into complemental ramp openings in the connector body to lock the insert assembly in position.

The ramp surfaces of the first and second ramp members are oppositely sloped so that the vertical ramp surfaces transfer axial forces on the strain relief fitting from the insert assembly to the associated connector body by means of the second ramp members, and then to the other connector body by means of the first ramp members.

Other objects and features of the invention will become apparent from consideration of the following description taken in connection with the accompanying drawings.

DESCRIPTION OF THE PREFERRED EMBODIMENT

Figure 1:
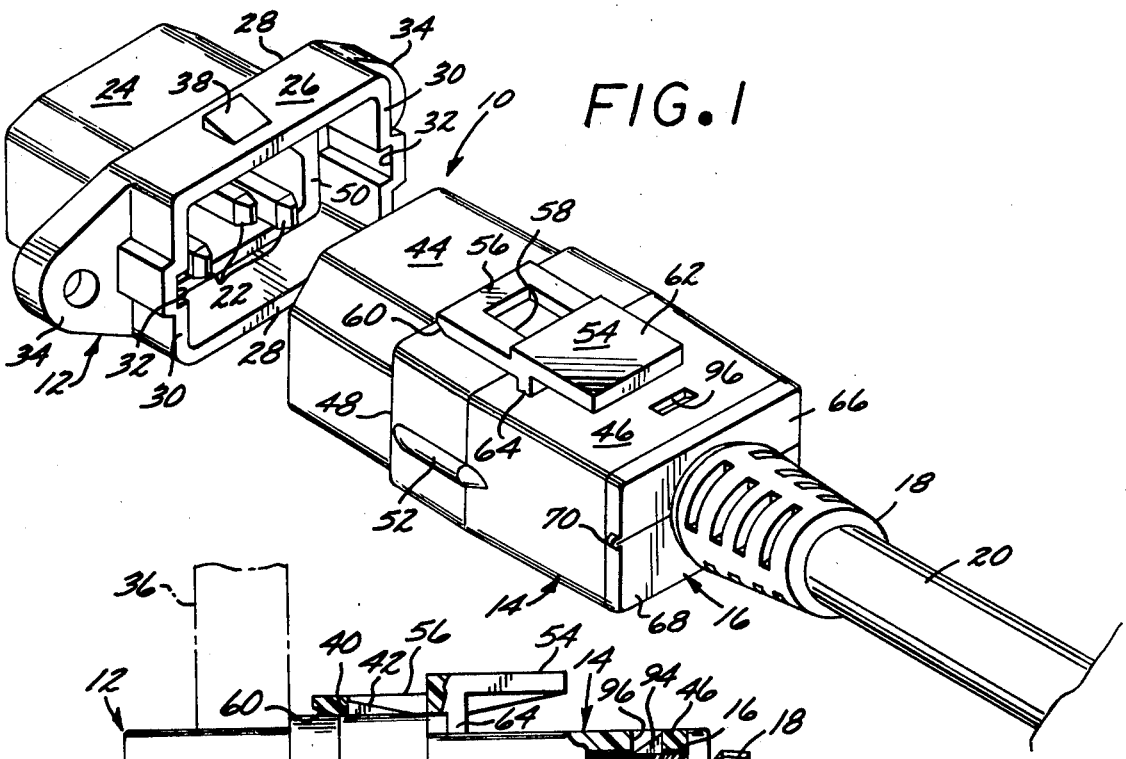
FIG. 1 is a perspective view of the electrical connector according to the present invention, the pair of connector bodies being illustrated in axially spaced apart relation.

Referring now to the drawings, there is illustrated an electrical connector 10 according to the present invention, and comprising a male or first connector body 12 and a female or second connector body 14, the second connector body 14 being adapted to slidably receive an insert assembly 16 within which is seated a strain relief fitting 18 molded or otherwise mounted upon a usual power cord 20 whose internal wires terminate in three electrical contacts (not shown) adapted to axially slidably receive three axially extending electrical connector blades 22 interiorly located and fixed within the first connector body 12.

The first connector body 12 is shown in the form of an appliance inlet for a typewriter or the like, the blades 22 being connected to the typewriter motor by any suitable electrical cord or conduit (not shown).

The connector body 12 includes a closed end hollow portion 24 of generally rectangular transverse cross-section except for beveled or sloping upper corners. The body 12 further includes a shroud or sleeve 26 integral with the portion 24 and also of generally rectangular cross-section, although somewhat larger in height and width. The sleeve 26 is characterized by horizontal walls 28 and vertical walls 30 in which are formed a pair of elongated, axially extending and oppositely disposed ways of slots 32. In addition, the sleeve 26 includes laterally extending flanges 34 having fastener openings for securing the body 12 to fixed structure such as a wall 36 associated with the typewriter.

Figure 2:
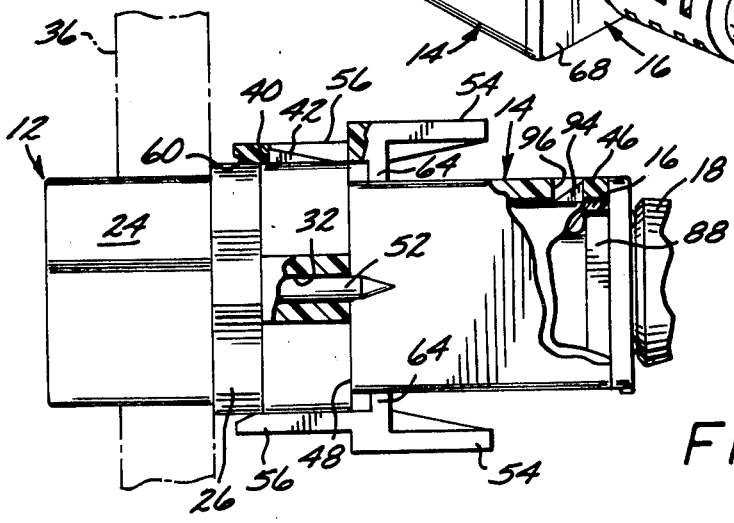
FIG. 2 is a side elevational view of the electrical connector of FIG. 1, the connector bodies being illustrated in assembled relation, with portions shown in cross-section.

The outer surfaces of the horizontal walls 28 of the sleeve 26 include a pair of oppositely disposed first ramp members 38 which are each characterized by a vertical wall 40 and a sloping ramp 42, as best seen in FIG. 2.

The second connector body 14 includes a closed end plug portion 44 adapted to axially slidably fit within the hollow interior of the portion 24 of the other connector body 12, the upper corners of the generally rectangular plug portion 44 being sloped to complementally fit within the sloped upper corners of the portion 24. The closed end of the plug portion 44 includes three openings, (not shown) through which the blades 22 can project when the plug portion 44 is within the portion 24 in the assembled or insert position of the bodies 12 and 14.

Integral with the plug portion 44 is a hollow housing portion 46 having an open end for receiving the insert assembly 16, as will be seen.

The housing portion 46 is of generally rectangular configuration in transverse cross-section, and its exterior dimensions are larger than the corresponding dimensions of the plug portion 44, thereby defining a perimetrical abutment wall 48 which is spaced slightly away from the base wall 50 of the first connector body sleeve 26 in the insert position of the bodies 12 and 14.

The opposite sides of the housing portions 46 include a pair of elongated, axially extending projections or guides 52 which slidably fit and seat within the slots 32 of the first connector body 12 in the insert position of the bodies, serving to axially align the bodies and particularly to prevent drooping of the connector body 14 relative to the connector body 12 under the weight of the power cord 20.

The housing portion 46 includes exteriorly located upper and lower lock members 54 which are integrally molded as a part of the main body of the housing portion 46. Such lock members 54 are well known in the prior art, the particular lock members 54 of the present invention each being characterized by a generally rectangular front projection 56 having a rectangular central ramp opening 58 and a downwardly and inwardly sloped leading edge 60. Each lock member 54 also includes an oppositely extending, generally rectangular rear projection 62 which can be depressed to pivot the lock member 54 about a vertical leg 64 which integrally joins the lock member 54 to the housing portion 46. Such pivotal movement, as will be seen, raises the front projection 56 so that it will disengage the associated first ramp member 38.

The connector body 14 is preferably made of nylon or similar material which can be molded to provide a vertical leg 64 adapted to be deformed to provide the desired pivotal movement of the lock member 54, while yet resisting cracking or other structural failure which repetitive pivoting would cause in many other materials.

Figure 3:
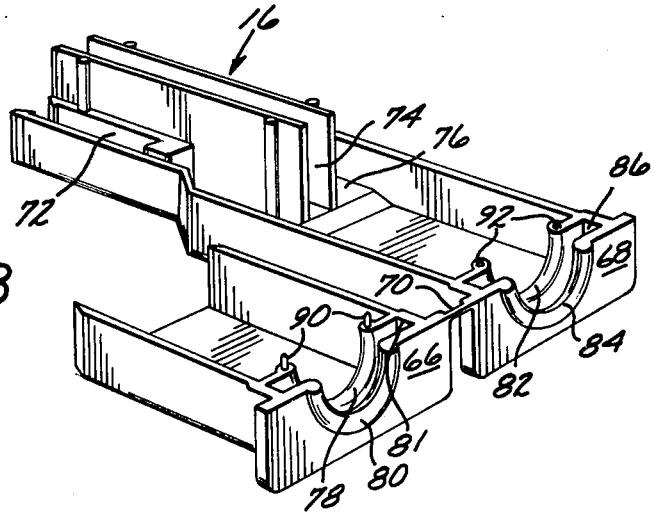
FIG. 3 is a perspective view of the insert assembly on an enlarged scale, the assembly being shown in its open position prior to seating of the power cord strain relief fitting.

The insert assembly 16 which slidably axially fits within the open end of the housing portion 46 comprises an upper half 66 and a lower half 68 which are preferably moled in one piece, being joined by a hinge section 70, as best seen in FIG. 3. The lower half 68 is longer than the upper half 66 to provide usual cavities or recesses 72, 74 and 76 for seating and retention of the usual electrical connectors (not shown) forming the terminations of the wires in the power cord 20.

The insert upper half 66 includes a pair of end walls 78 and 80 which are spaced apart to define a collar recess 81, the other half 68 also including end walls 82 and 84 which are spaced apart to define a collar recess 86. All of these end walls include semi-cylindrical openings so that, upon movement of the upper half 66 onto the lower half 68 by bending at the hinge section 70, a generally rectangular collar recess is formed having a circular opening therethrough. The strain relief fitting 18 fits through the circular opening, and a collar 88 of the fitting 18 fits within the collar recess formed by the recesses 81 and 86. The collar 18 is made of relatively rigid or non-elastomeric material so that it is incapable of being unseated from the collar recess by pulling upon the power cord 20.

Pins 90 on the end wall 78 fit within openings 92 in the end wall 82 to properly locate the insert halves 66 and 68 for assembly.

With the foregoing arrangement, any axial pull or power cord separation forces imposed on the collar 88 are transferred to the adjacent structure of the insert assembly 16 and not to the electrical wiring and blade/-contact connections.

A pair of second ramp members 94, as best seen in FIG. 2, are integrally molded on the outer, opposite surfaces of the halves 66 and 68. Each ramp member 94 includes a surface which slopes oppositely of the slope of the first ramp members 38. Upon insertion of the insert assembly 16 into the open end of the second connector body 14, the ramps 94 upwardly deflect the walls of the housing portion 46 until the ramps 94 come into alignment with a pair of ramp openings 96 in the upper and lower walls of the housing portion 46, at which point the outwardly deflected walls resume their unstressed positions and capture the ramp members 94 within the ramp openings 96 and prevent withdrawal of the insert assembly 16. The only way the insert assembly 16 can be removed is by application of sufficient pressure upon the ramp members 94 to move them inwardly and out of the ramp openings 96.

From the foregoing it will be apparent that any forces developed by pulling upon the cord 20 will be transmitted to the insert assembly 16, and from the insert assembly 16 to the connector body 14 by means of the second ramp members 94, and then to the connector body 12 by means of the first ramp members 38. The integrity of the electrical connection between the bodies 12 and 14 is thus maintained, despite relatively high connector and power cord separation forces, since all of such forces are borne by the wall 36 to which the connector body 12 is secured.

Various modifications and changes may be made with regard to the foregoing detailed description without departing from the spirit of the invention.

We claim:

1. An electrical connector having opposed locking ramp members to resist connector and power cord separation forces, said electrical connector comprising:

a hollow first connector body including interiorly located, axially extending electrical connector blades, and exteriorly located first ramp means;

a hollow second connector body adapted to fit within said first connector body in an insert position, said second connector body having an open end, ramp engaging means, and exteriorly located pivotable lock means adapted to ride up upon and latch behind said first ramp means in said insert position to lock said second connector body within said first connector body;

a strain relief fitting for mounting upon a power cord having axially extending electrical contacts for receiving said connector blades, said strain relief fitting including a collar; and an insert assembly insertable into said open end of said second connector body and adapted to mount said electrical contacts, said insert assembly including a collar recess for receiving said collar and for constraining said strain relief fitting against axial movement relative to said insert assembly, said insert assembly further including exteriorly located second ramp means adapted to engage said ramp engaging means whereby axial forces on said strain relief fitting are transferred from said insert assembly to said second connector body by means of said second ramp means, and to said first connector body by means of said first ramp means.

2. An electrical connector according to claim 1 wherein said insert assembly comprises half sections movable from an open position for receiving said collar to a closed position encompassing said collar for capturing said collar in said collar recess prior to insertion of said insert assembly into said second connector body.

3. An electrical connector having opposed locking ramp members to resist connector and power cord separation forces, said electrical connector comprising:

a hollow first connector body including interiorly located, axially extending electrical connector blades, an interiorly located pair of elongated, axially extending and oppositely disposed slots, and an exteriorly located pair of inclined, oppositely disposed first ramp members;

a hollow second connector body adapted to fit within said first connector body in an insert position, said second connector body having an open end and a pair of oppositely disposed ramp openings extending from within said second connector body, said second connector body further having an exteriorly located pair of elongated, axially extending and oppositely disposed guides for seating within said slots of said first connector body in said insert position, said second connector body further having an exteriorly located pair of oppositely disposed, pivotable lock members adapted to ride up upon and latch behind said first ramp members in said insert position to lock said second connector body within said first connector body;

a strain relief fitting for mounting upon a power cord having axially extending electrical contacts for receiving said connector blades, said strain relief fitting including a collar; and an insert assembly insertable into said open end of said second connector body and adapted to mount said electrical contacts, said insert assembly including a collar recess for receiving said collar and for constraining said strain relief fitting against axial movement relative to said insert assembly, said insert assembly further including an exteriorly located pair of inclined, second ramp members adapted to project into said pair of ramp openings in said second connector body, said second ramp members being inclined oppositely of said first ramp members whereby axial forces on said strain relief fitting are transferred from said insert assembly to said second connector body by means of said second ramp members, and to said first connector body by means of said first ramp members.

* * * * *